US008322974B2

(12) United States Patent
Chen

(10) Patent No.: US 8,322,974 B2
(45) Date of Patent: Dec. 4, 2012

(54) FAN MODULE WITH VIBRATION-RESISTENT MOUNTING

(75) Inventor: Chih-Hua Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 552 days.

(21) Appl. No.: 12/647,432

(22) Filed: Dec. 25, 2009

(65) Prior Publication Data

US 2011/0135448 A1 Jun. 9, 2011

(30) Foreign Application Priority Data

Dec. 3, 2009 (TW) ..... 98141429 A

(51) Int. Cl.

| | |
|---|---|
| ***F03D 11/00*** | (2006.01) |
| ***F01D 5/00*** | (2006.01) |
| ***F01D 25/04*** | (2006.01) |
| ***F01D 25/26*** | (2006.01) |
| ***F03B 11/00*** | (2006.01) |

(52) U.S. Cl. ..... 415/119; 415/213.1

(58) Field of Classification Search ..... 415/119, 415/213.1, 214.1, 220, 223, 175–178; 248/694, 248/638

See application file for complete search history.

(56) References Cited

U.S. PATENT DOCUMENTS

| | | | | |
|---|---|---|---|---|
| 4,598,894 | A * | 7/1986 | Johannes | 248/615 |
| 2004/0202541 | A1 * | 10/2004 | Stewart et al. | 415/213.1 |
| 2009/0057524 | A1 * | 3/2009 | Chen | 248/638 |

* cited by examiner

*Primary Examiner* — Christopher Verdier
*Assistant Examiner* — Su Htay
(74) *Attorney, Agent, or Firm* — Altis Law Group, Inc.

(57) ABSTRACT

A fan module includes a cooling fan, a support rack, and four fasteners fixing the cooling fan to the support rack. The fasteners are vibration-resistant material, and are disposed between the support rack and the cooling fan, and below the cooling fan.

12 Claims, 8 Drawing Sheets

FAN MODULE WITH VIBRATION-RESISTENT MOUNTING

BACKGROUND

1. Technical Field

The disclosure generally relates to fan modules, and particularly to a fan module with vibration-resistant mounting.

2. Description of Related Art

A frequently used cooling fan is needed for a computer and usually mounted on a computer enclosure via screws. During operation, the cooling fan can generate undesirable vibration, with resulting computer enclosure vibration noise generated. Worse yet, such vibration can adversely affect other components in the enclosure, such as hard disc and other assets.

What is needed, therefore, is a fan module with vibration-resistant mounting which can overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
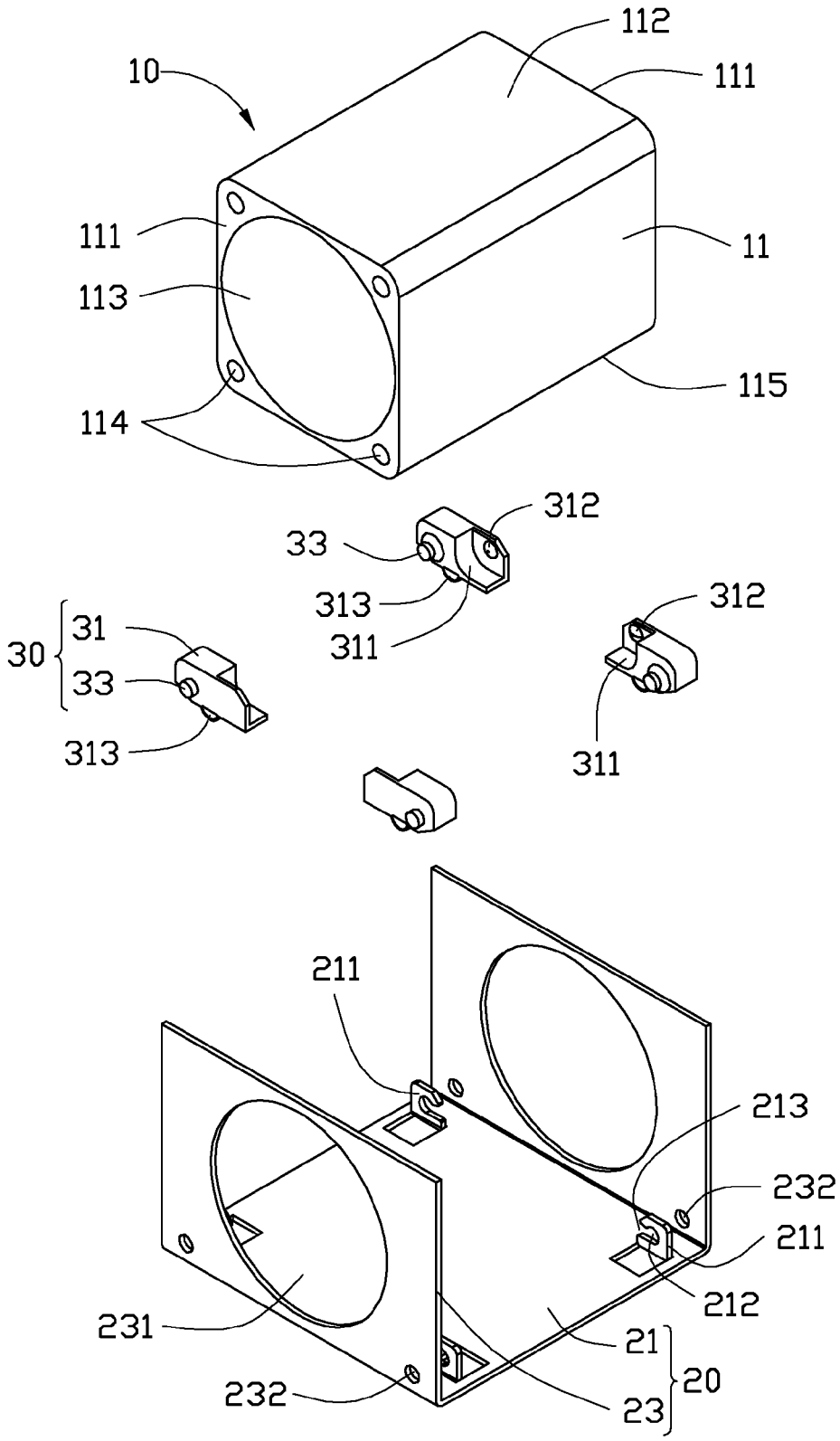
FIG. 1 is an exploded, isometric view of a fan module in accordance with a first embodiment of the disclosure.

Referring to FIG. 1, a fan module in accordance with a first embodiment is shown. The fan module includes a cooling fan 10, a support rack 20, and four fasteners fixing the cooling fan 10 to the support rack 20.

The cooling fan 10 includes a frame 11 and an impeller (not shown) in the frame 11. The frame 11 is cuboid and hollow, and defines a cylindrical receiving hole 113 therein for receiving the impeller. The frame 11 includes two rectangular side surfaces 111 and four peripheral surfaces 112 interconnecting the side surfaces 111. The receiving hole 113 extends through the two side surfaces 111. Airflow entering the receiving hole 113 from one of the side surfaces 111 is enhanced by the impeller, and exits via the receiving hole 113 at the other side surface 111. Two mounting holes 114 are defined in bottom corners of each of the side surfaces 111, respectively. A convex connecting portion 115 is formed between every two adjacent peripheral surfaces 112.

The support rack 20 is substantially U-shaped and integrally bent from a single metal plate. The support rack 20 includes a base 21 and two sidewalls 23 extending upward from opposite lateral sides of the base 21 respectively.

The base 21 is rectangular. A support flange 211 is punched upward from each of the four corners of the base 21. The support flanges 211 of the base 21 are located between the sidewalls 23 of the support rack 20. The support flanges 211 are parallel to and spaced from the sidewalls 23. Each of the support flanges 211 is hook shaped, and defines therein a circular pivot hole 212 and an opening 213 toward an interior of the support rack 20. The pivot hole 212 communicates with the exterior via the opening 213.

The sidewalls 23 are rectangular and parallel to each other. Each of the sidewalls 23 defines a circular air outlet 231 in a center thereof. The air outlet 231 aligns with the receiving hole 113 of the cooling fan 10. Two pivot holes 232 are defined in two bottom corners of each sidewall 23, respectively. The pivot holes 232 align with the pivot holes 212 of the support flanges 211, respectively.

The fasteners 30 are disposed between the cooling fan 10 and the support rack 20, and located below the cooling fan 10. The fasteners 30 are of vibration resistant material such as rubber, foam, or other. Each of the fasteners 30 includes a main body 31 and two pivots 33 extending perpendicularly from two opposite side surfaces of the main body 31 respectively.

The main body 31 is substantially cuboid, and defines a recess 311 in a top corner thereof. The recess 311 faces the interior of the support rack 20. An inner side of the main body 31 in the recess 311 is concave, matching a corresponding convex connecting portion 115 of the frame 11 of the cooling fan 10. A protrusion 312 with an arcuate outer surface extends into the recess 311 from the main body 31 perpendicular to the sidewalls 23 of the support rack 20. The main body 31 forms an elastic portion 313 at a middle of a bottom surface thereof. The elastic portion 313 is hollow and semi-cylindrical with an arcuate and downward side surface.

The pivots 33 are integrally formed with the main body 31 as a signal piece at one end of the main body 31 away from the recess 311. Each of the pivots 33 extends perpendicular to the sidewalls 23 of the support rack 20. A distance between each of the support flanges 211 and a corresponding sidewall 23 exceeds a width of each of the main bodies 31 along a longitudinal direction of the pivots 33, but less than a distance between two free ends of the pivots 33.

Figure 2:
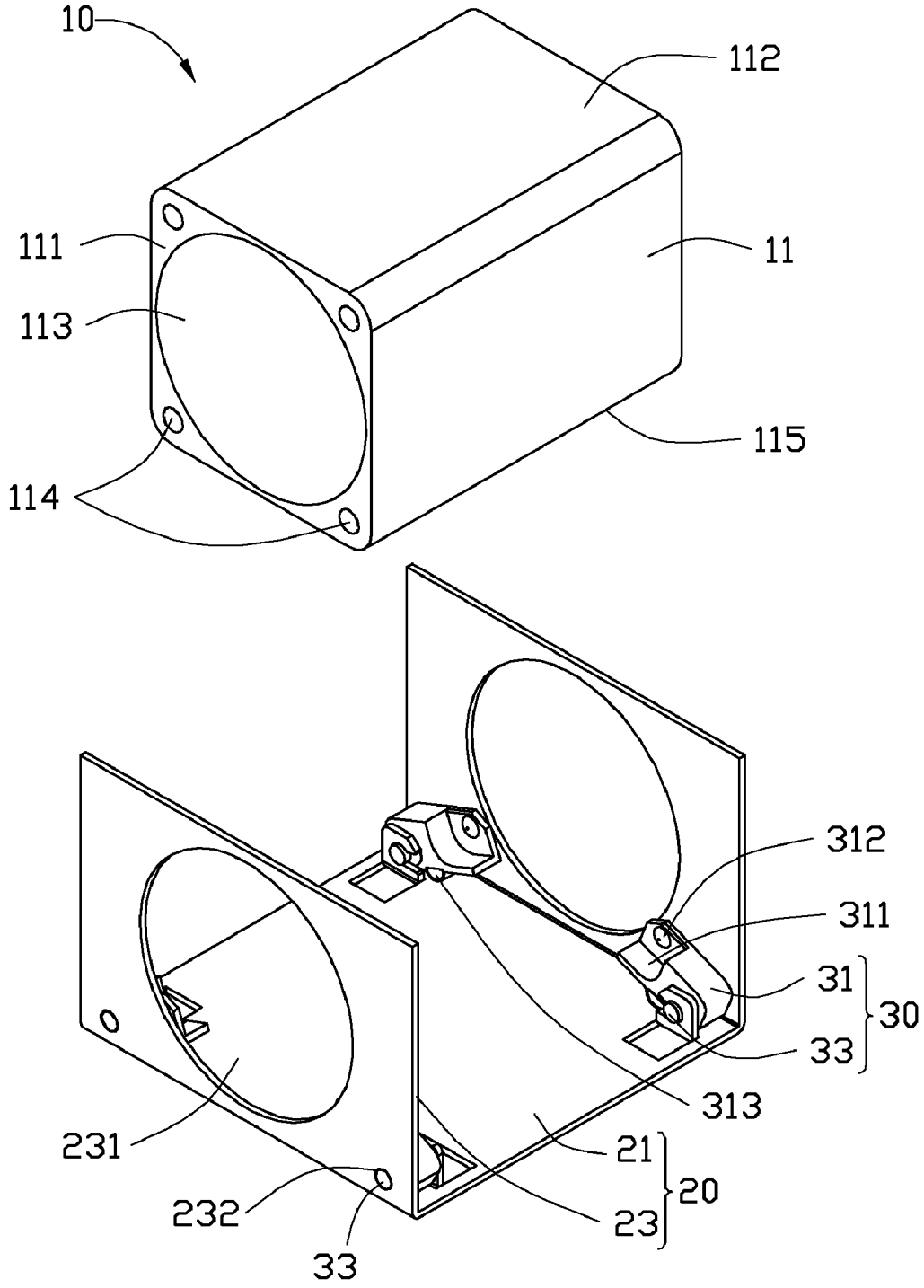
FIG. 2 is similar to FIG. 1, but showing a plurality of fasteners mounted on a support rack of the fan module.

Referring to FIG. 2, during assembly, the fasteners 30 correspond to the support flanges 211 of the base 21 of the support rack 20, respectively. One end of each fastener 30, with the pivots 33, is aligned with one end of a corresponding support flange 211, with the opening 213. Each fastener 30 is impelled toward the corresponding support flange 211 from the interior of the support rack 20, until one of the pivots 33 of each fastener 30 is received in the pivot hole 212 of the corresponding support flange 211 from the opening 213. Each fastener 30 is then impelled toward a corresponding sidewall 23 of the support rack 20, until the other one of the pivots 33 of each fastener 30 are received in the pivot hole 232 of the corresponding sidewall 23. At this time, the pivots 33 of each fastener 30 are pivotally received in the pivot hole 212 of the corresponding support flange 211 and the pivot hole 232 of the corresponding sidewall 23, respectively. The recess 311 of each fastener 30 faces the interior of the support rack 20. The elastic portion 313 of each fastener 30 abuts the base 21 of the support rack 20. One end of the main body 31 of each fastener 30, with the recess 311, angles upwardly.

Figure 3:
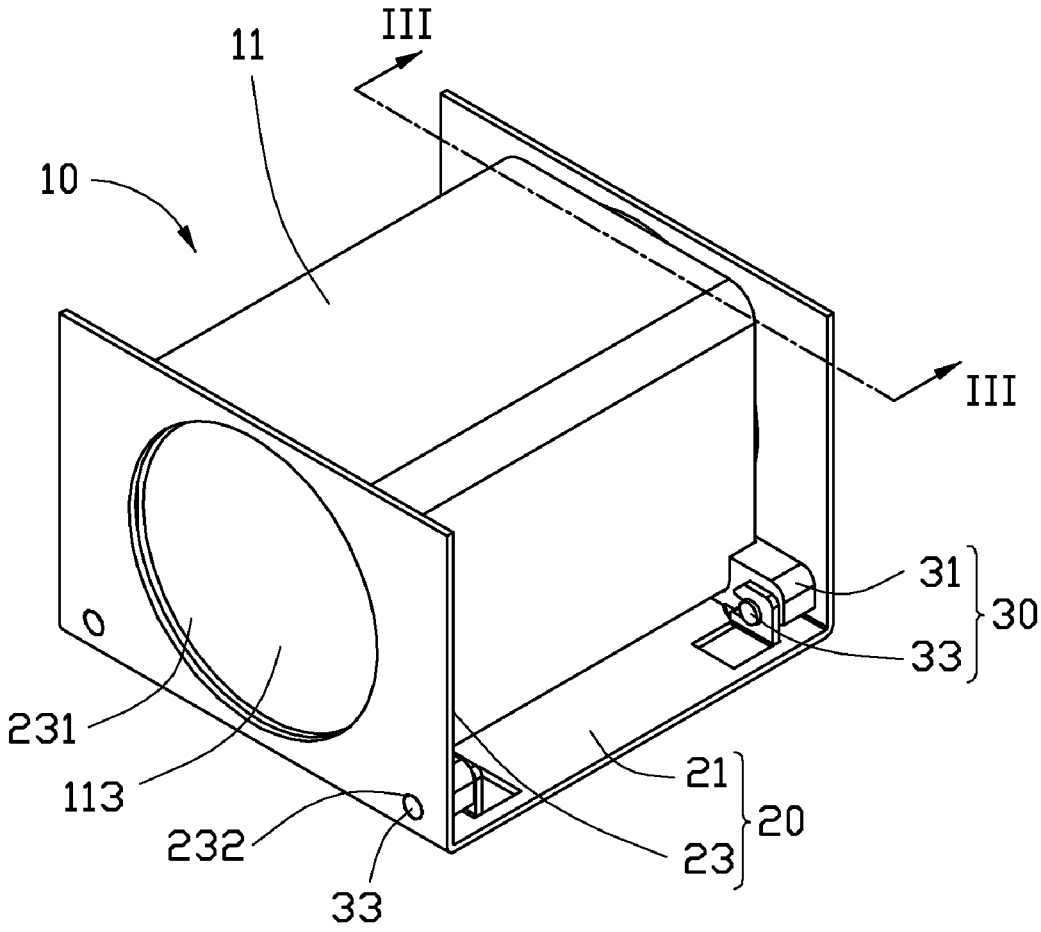
FIG. 3 is an assembled, isometric view of the fan module of FIG. 1.
Figure 4:
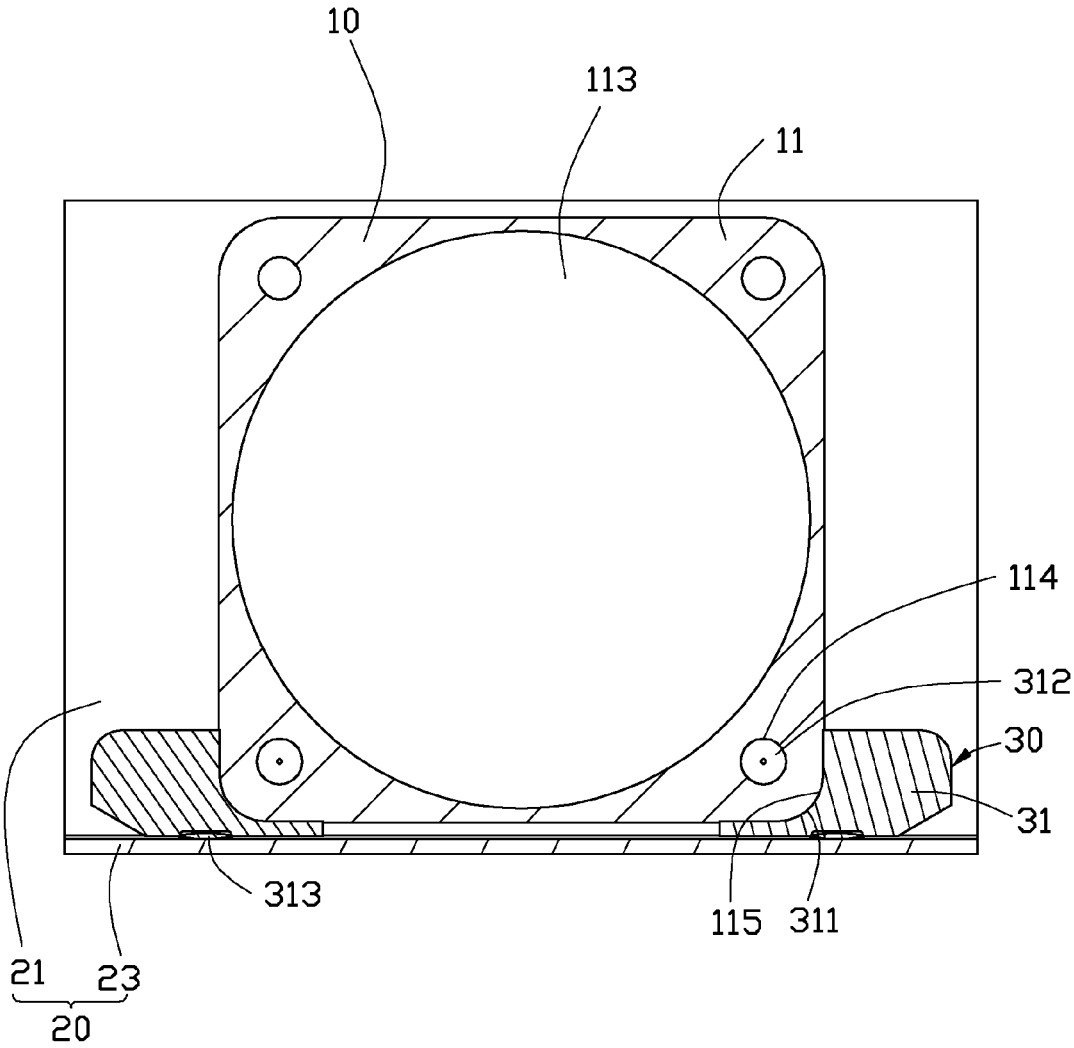
FIG. 4 is a cross section of the fan module of FIG. 3, taken along line IV-IV thereof.

Four bottom corners of the frame 11 of the cooling fan 10 are aligned with the recesses 311 of the four fasteners 31, respectively. When the cooling fan 10 is moved toward the fasteners 31, the protrusion 312 of each fastener 31 is received in a corresponding mounting hole 114 of the frame 11 of the cooling fan 10 along a corresponding side surface 111 of the frame 11. At this time, as shown in FIGS. 3 and 4, the elastic portion 313 of each fastener 30 is depressed by the cooling fan 20 and thereby deforms. The previously angled end of the main body 31 of each fastener 30 thereby contacts the base 21 of the support rack 20. The four bottom corners of the frame 11 of the cooling fan 10 are received in the recesses 311 of the four fasteners 30, respectively. Each convex connecting portion 115 at a bottom end of the frame 11 of the cooling fan 10 matches the concave inner side of the main body 31 in the recess 311 of a corresponding fastener 30.

In the fan module as disclosed, the fasteners 30 are vibration-resistant material, located between the cooling fan 10 and the support rack 20. The four bottom corners of the frame 11 of the cooling fan 10 are received in the recesses 311 of the four fasteners 30, respectively. Accordingly, the cooling fan 10 is isolated from the support rack 20 via the fasteners 30, avoiding contact with the computer enclosure upon which the support rack 20 is mounted. During operation, vibration transfer between the cooling fan 10 and the support rack 20 is thus reduced, as is resulting computer enclosure vibration noise.

In addition, installation of the cooling fan 10 on the support rack 20 by a simple push action, and removed by reversal of the same, simplifying both operations and further decreasing the cost of the fan module.

Additionally, the elastic portion 313 at the bottom surface of each fastener 31 further reduces vibration transfer between the cooling fan 10 and the support rack 20. As well, if the cooling fan 10 is slightly smaller or larger than normal, mounting thereof on the support rack 20 is still achievable by minor deformation of the elastic portion 313. Thus, adaptability of the fan module is also improved.

Figure 5:
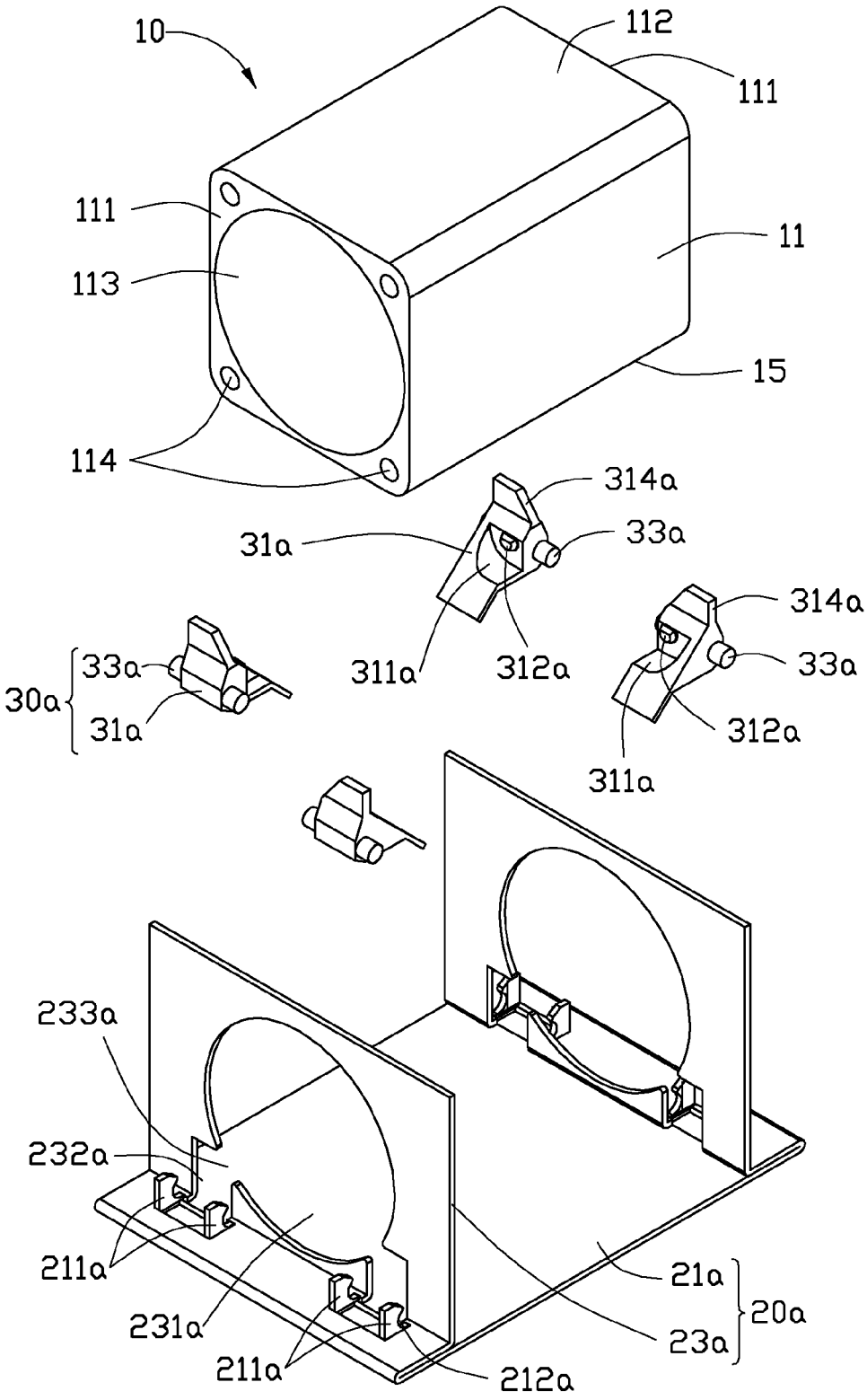
FIG. 5 is an exploded, isometric view of a fan module in accordance with a second embodiment of the disclosure.

Referring to FIG. 5, a fan module in accordance with a second embodiment is shown. The fan module of the second embodiment differs from the fan module of the first embodiment only in the support rack and the fasteners.

In this embodiment, a support rack 20*a* is substantially inverse U-shaped, and is integrally bent from a single metal plate. The support rack 20*a* includes a base 21*a* and two sidewalls 23*a* extending upward from the base 21*a* respectively.

The base 21*a* is rectangular. A pair of support flanges 211*a* is formed by punching from each of the four corners of the base 21*a*. The support flanges 211*a* of the base 21*a* are located out of the sidewalls 23*a*. Each pair of support flanges 211*a* are parallel, and perpendicular to the sidewalls 23*a*. Each of the support flanges 211*a* is spaced from the sidewalls 23*a*. A semicircular pivot hole 212*a* is defined at an outer periphery of each support flange 211 a toward a corresponding sidewall 23*a*.

The sidewalls 23*a* are rectangular, and parallel. Each of the sidewalls 23*a* defines a circular air outlet 231*a* in a center thereof, and two through holes 232*a* respectively in two bottom corners thereof. The air outlet 231*a* aligns with the receiving hole 113 of the cooling fan 10. Each of the through holes 232*a* is rectangular, and aligns with a pair of support flanges 211*a*. Each of the sidewalls 23*a* further defines therein two cutouts 233*a* above the through holes 232*a*, respectively. The cutouts 233*a* are in communication with the through holes 232*a* and the air outlet 231*a*, respectively.

Four fasteners 30*a* are disposed between the cooling fan 10 and the support rack 20*a*, and located below the cooling fan 10. The fasteners 30*a* are vibration-resistant material such as rubber, foam, or other. Each of the fasteners 30*a* includes a main body 31*a* and two pivots 33*a* extending perpendicularly from two opposite side surfaces of the main body 31*a* respectively.

The main body 31*a* is substantially wedge-shaped, and defines a recess 311*a* in a middle of a top surface thereof. The recess 311*a* faces an interior of the support rack 20*a*. An inner side of the main body 31*a* in the recess 311*a* is concave, matching a corresponding convex connecting portion 115 of the frame 11 of the cooling fan 10. A protrusion 312*a*, with an arcuate outer surface, extends into the recess 311*a* from the main body 31*a* perpendicular to the sidewalls 23*a* of the support rack 20*a*. An elastic portion 313*a* angles downwardly toward the base 21*a* of the support rack 20*a* from one end of the main body 31*a*. A stopper 314*a* extends upward from another end of the main body 31*a*. The elastic portion 313*a* and the stopper 314*a* are tabs. The elastic portion 313*a* is thinner than the stopper 314*a*. An obtuse angle is defined between the elastic portion 313*a* and a bottom surface of the main body 31*a*.

The pivots 33*a* are integrally formed with the main body 31*a* as a single piece at one end of the main body 31*a* away from the recess 311*a*. The pivots 33*a* are located below the stopper 314*a*. Each of the pivots 33*a* extends parallel to the sidewalls 23*a* of the support rack 20*a*. A distance between each pair of support flanges 211*a* exceeds a width of each of the main body 31*a* along a longitudinal direction of the pivots 33*a*, but less than a distance between two free ends of the pivots 33*a*. Each main body 31*a* is narrower along the axis of the pivots 33*a* than a corresponding through hole 232*a* of the support rack 20*a*.

Figure 6:
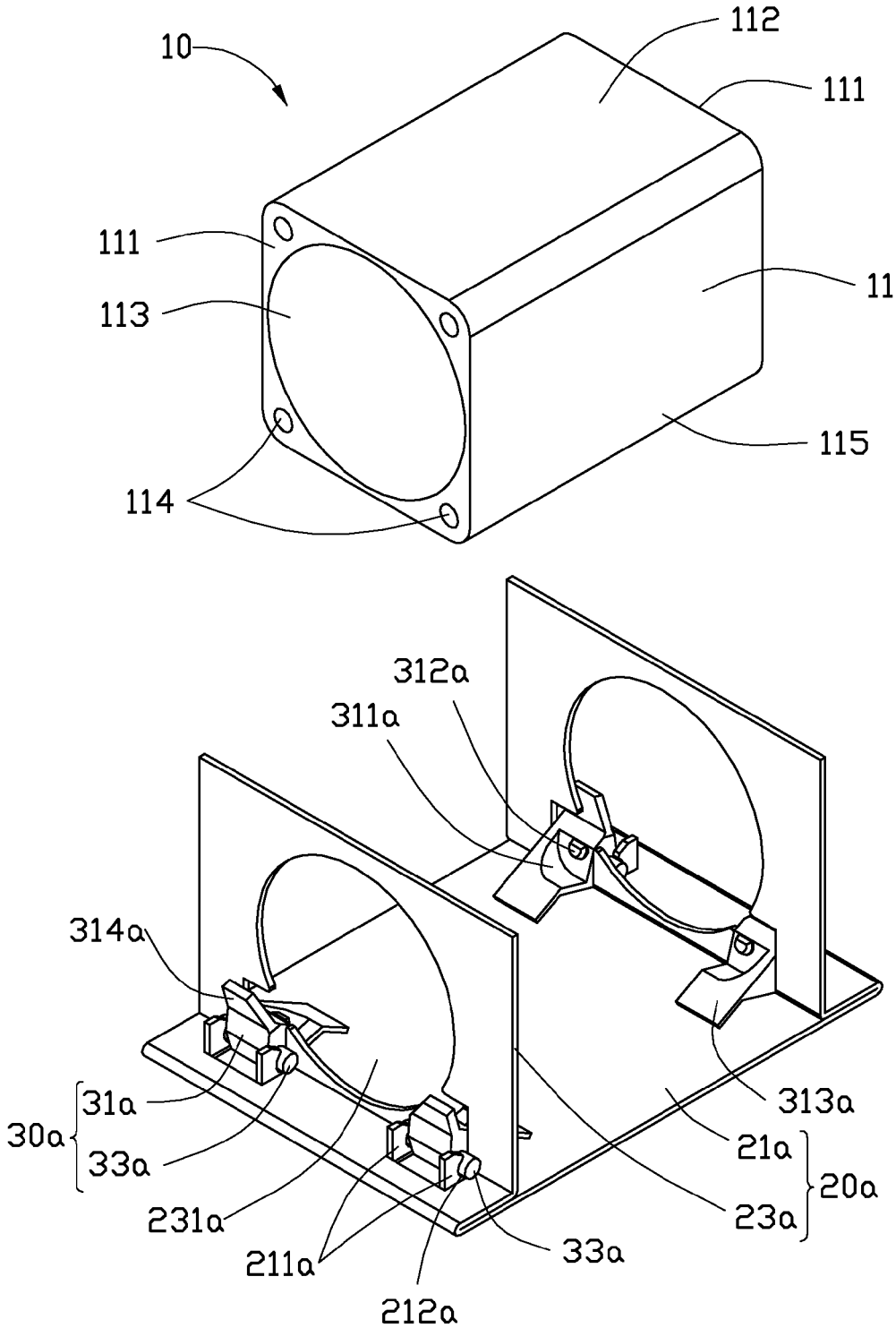
FIG. 6 is similar to FIG. 5, but shows a plurality of fasteners mounted on a support rack of the fan module.

Referring to FIG. 6, during assembly, the fasteners 30*a* correspond to the support flanges 211*a* of the base 21*a* of the support rack 20*a*, respectively. One end of each fastener 30*a*, with the elastic portion 313*a*, is positioned between the sidewalls 23*a* of the support rack 20*a*. Another end of each fastener 30*a*, with the stopper 314*a*, is positioned out of the sidewalls 23*a* of the support rack 20*a*. Each fastener 30*a* is impelled into a corresponding through hole 232*a* of the support rack 20*a* via a corresponding cutout 233*a*. The pivots 33*a* of each fastener 30*a* are positioned between a corresponding sidewall 23*a* and a corresponding pair of support flanges 211*a*. Each fastener 30*a* is impelled toward the corresponding pair of support flanges 211*a* from the interior of the support rack 20*a*, until the pivot 33*a* of each fastener 30*a* is pivotally received in the pivot holes 212*a* of the corresponding pair of support flanges 211*a*. At this time, the recess 311*a* of each fastener 30*a* faces the interior of the support rack 20*a*. A free end of the elastic portion 313*a* of each fastener 30*a* abuts the base 21*a* of the support rack 20*a*, whereby one end of the main body 31*a* of each fastener 30*a*, with the elastic portion 313*a*, angles upwardly, and the stopper 314*a* of each fastener 30*a* angles outwardly.

Figure 7:
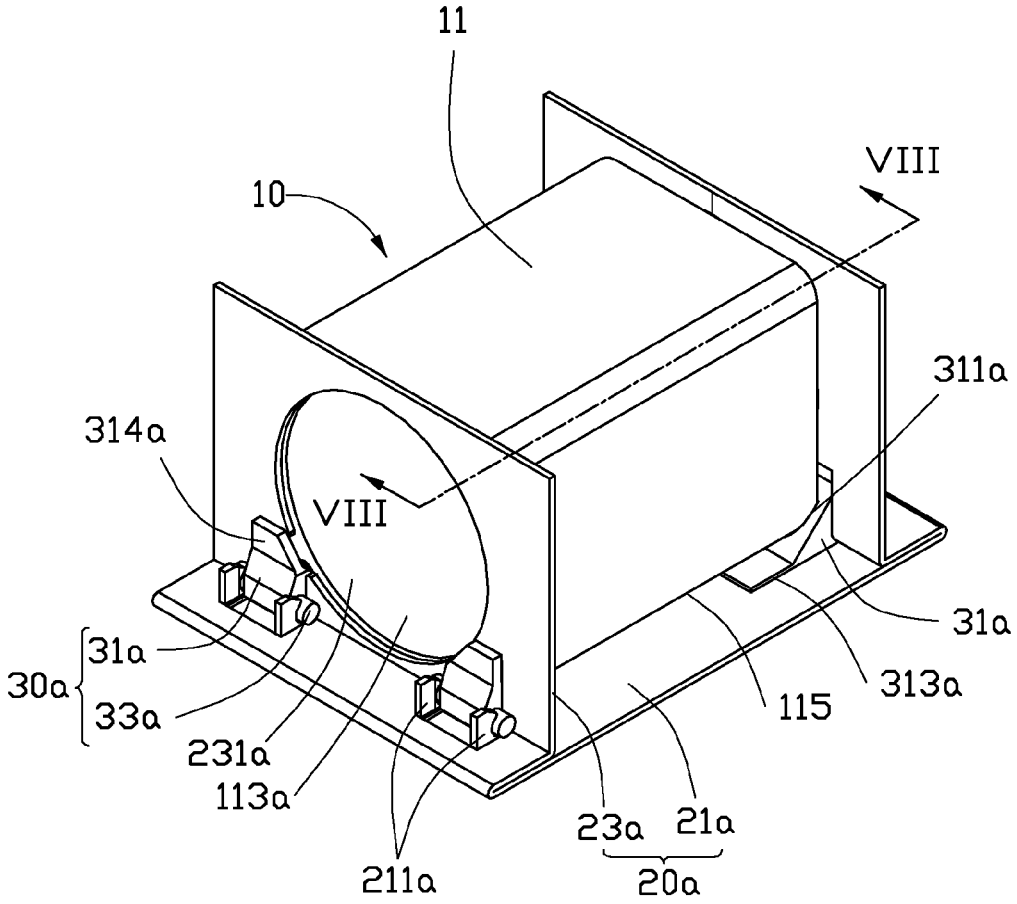
FIG. 7 is an assembled, isometric view of the fan module of FIG. 5.
Figure 8:
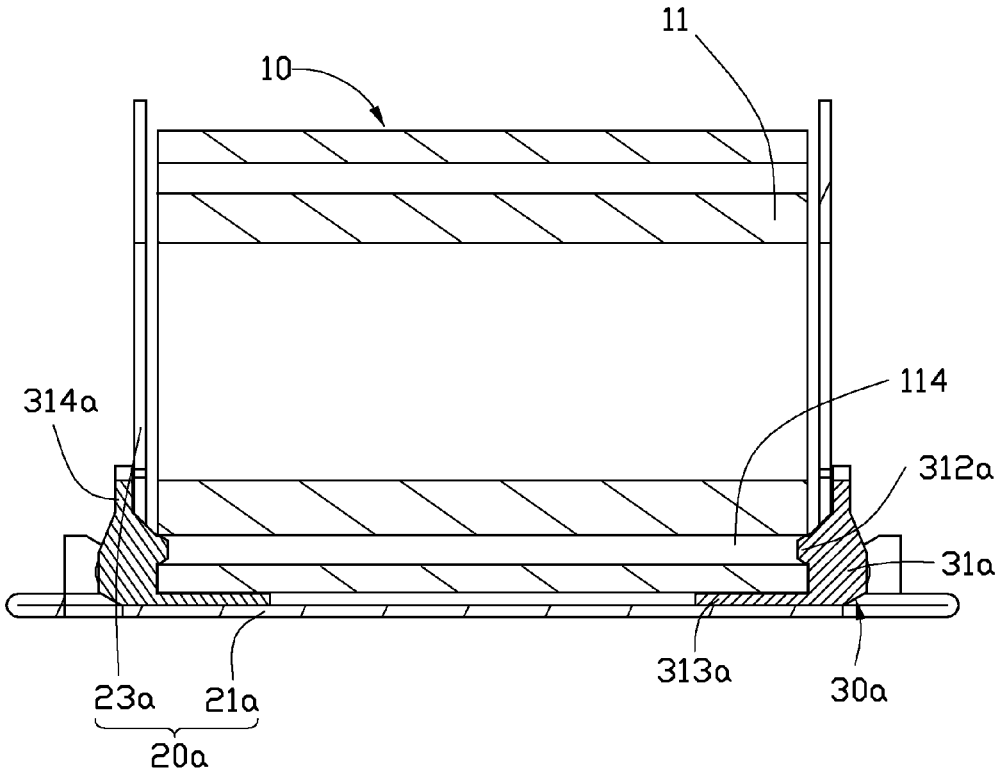
FIG. 8 is a cross section of the fan module of FIG. 7, taken along line VIII-VIII thereof.

The four bottom corners of the frame 11 of the cooling fan 10 align with the recesses 311*a* of the four fasteners 31*a*, respectively. Pressure on cooling fan 10 toward the fasteners 31*a* brings each protrusion 312*a* of each fastener 31*a* to be received in a corresponding mounting hole 114 of the frame 11 of the cooling fan 10 along a corresponding side surface 111 of the frame 11. At this time, as shown in FIGS. 7 and 8, the elastic portion 313*a* of each fastener 30*a* is depressed by the cooling fan 20*a* and deforms slightly. The previously angled end of the main body 31*a* of each fastener 30*a* thereby contacts the base 21*a* of the support rack 20*a*. The four bottom corners of the frame 11 of the cooling fan 10 are received in the recesses 311*a* of the four fasteners 30*a*, respectively. Each convex connecting portion 115 at a bottom end of the frame 11 of the cooling fan 10 matches the concave inner side of the main body 31*a* in the recess 311*a* of a corresponding fastener 30*a*. The stopper 314*a* of each fastener 30*a* abuts an outer side surface of a corresponding sidewall 23*a* of the support rack 20*a*.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan module, comprising:

a cooling fan;

a support rack; and a plurality of fasteners mounting the cooling fan to the support rack, the fasteners comprising vibration-resistant material and disposed between the cooling fan and the support rack, and below the cooling fan;

wherein each of the fasteners comprises a main body defining a recess therein, the recess of each of the fasteners facing an interior of the support rack, a portion of the cooling fan received in the recess of each of the fastener;

wherein each of the fasteners further comprises two pivots extending from two opposite side surfaces of the main body respectively, the support rack comprising a plurality of support flanges, each defining a pivot hole therein receiving one corresponding pivot; and wherein the support rack comprises a base and two sidewalls extending upward from the base respectively, the support flanges extending upward from the base of the support rack, between the sidewalls of the support rack, the support flanges spaced from the sidewalls of the support rack, the main body of each fastener disposed between the corresponding support flange and the corresponding sidewall of the support rack, the sidewalls of the support rack defining therein a plurality of pivot holes at bottom ends thereof, the pivot holes of the sidewalls aligning respectively with the pivot holes of the support flanges, and the two pivots of each fastener pivotally received in the corresponding pivot hole of the sidewalls and the corresponding pivot hole of the support flanges, respectively.

2. The fan module of claim 1, wherein a protrusion extends into the recess from the main body of each of the fasteners, and the cooling fan comprises a frame defining a plurality of mounting holes therein, the protrusions of the fasteners received in the mounting holes of the cooling fan, respectively.

3. The fan module of claim 1, wherein the main body of each fastener comprises an elastic portion at a bottom surface thereof, the elastic portions deforming and abutting the base of the support rack when the cooling fan is mounted on the support rack.

4. The fan module of claim 1, wherein the base of the support rack is rectangular, the plurality of support flanges comprises four or four pairs of support flanges respectively located at four corners of the base, the plurality of fasteners comprises four fasteners respectively matching the four or four pairs of support flanges, four bottom corners of a frame of the cooling fan respectively received in the recesses of the four fasteners.

5. A fan module, comprising:

a cooling fan;

a support rack comprising a base and two sidewalls extending upward from the base respectively, a plurality of support flanges extending upward from the base, each of the support flanges defining a pivot hole therein; and a plurality of fasteners, each comprising a pivot extending out therefrom, the pivots pivotally received in the pivot holes of the support flanges, respectively, and the cooling fan mounted on the base via the fasteners and located between the sidewalls of the support rack;

wherein the support flanges are located outside the sidewalls of the support rack, every two support flanges cooperate with each other, the sidewalls of the support rack define a plurality of through holes therein, and each of the fasteners passes through the corresponding through hole of the support rack.

6. The fan module of claim 5, wherein each of the fasteners defines a recess therein, each facing an interior of the support rack, and a portion of the cooling fan is received in the recess of each of the fasteners.

7. The fan module of claim 6, wherein a protrusion extends into the recess from each of the fasteners, the cooling fan defines a plurality of mounting holes therein, and the protrusions of the fasteners are respectively received in the mounting holes of the cooling fan.

8. The fan module of claim 5, wherein the support flanges are located between the sidewalls of the support rack, and each of the fasteners is disposed between the corresponding support flange and the corresponding sidewall of the support rack.

9. The fan module of claim 5, wherein each fastener comprises an elastic portion extending toward the base of the support rack, wherein the elastic portions deform and abut the base of the support rack when the cooling fan is mounted on the support rack.

10. A fan module, comprising:

a cooling fan;

a support rack; and a plurality of fasteners mounting the cooling fan to the support rack, the fasteners comprising vibration-resistant material and disposed between the cooling fan and the support rack, and below the cooling fan;

wherein each of the fasteners comprises a main body defining a recess therein, the recess of each of the fasteners facing an interior of the support rack, a portion of the cooling fan received in the recess of each of the fastener;

wherein each of the fasteners further comprises two pivots extending from two opposite side surfaces of the main body respectively, the support rack comprising a plurality of support flanges, each defining a pivot hole therein receiving one corresponding pivot; and wherein the support rack comprises a base and two sidewalls extending upward therefrom respectively, the support flanges extending from the base of the support rack and every two thereof cooperating with each other and forming a pair, each of which is located outside from the sidewalls of the support rack, wherein the sidewalls of the support rack define therein a plurality of through holes at bottom ends thereof, each aligning with the corresponding pair of support flanges, and the main body of each fastener received in the corresponding through hole of the support rack, wherein the two pivots of each fastener are pivotally received in the pivot holes of the corresponding pair of support flanges, respectively.

11. The fan module of claim 10, wherein an elastic portion angles downwardly toward the base of the support rack from one end of the main body of each fastener, the elastic portion of each fastener located at the interior of the support rack, the elastic portion of each fastener being a tab, with an obtuse angle defined between the elastic portion and a bottom surface of the main body of each fastener, and the elastic portion of each fastener deforming and abutting the base of the support rack when the cooling fan is mounted on the support rack.

12. The fan module of claim 10, wherein a stopper extends upward from an end of the main body of each fastener, and the stopper of each fastener is located at an exterior of the support rack, being a tab and abutting an outer side surface of the corresponding sidewall of the support rack.

* * * * *